US008337174B2

(12) United States Patent
Abou Saleh

(10) Patent No.: US 8,337,174 B2
(45) Date of Patent: Dec. 25, 2012

(54) LONG-LIFE PUMP UNIT WITH A LINEAR ACTUATING MODULE

(75) Inventor: Khaled Abou Saleh, Paris (FR)

(73) Assignee: Pulssar Technologies, Gennevilliers (FR)

( * ) Notice: Subject to any disclaimer, the term of this patent is extended or adjusted under 35 U.S.C. 154(b) by 874 days.

(21) Appl. No.: 12/374,656

(22) PCT Filed: Jul. 11, 2007

(86) PCT No.: PCT/FR2007/001196

§ 371 (c)(1),
(2), (4) Date: Jun. 4, 2009

(87) PCT Pub. No.: WO2008/009797

PCT Pub. Date: Jan. 24, 2008

(65) Prior Publication Data

US 2009/0257893 A1 Oct. 15, 2009

(30) Foreign Application Priority Data

Jul. 18, 2006 (FR) ..... 06 06474
Jan. 3, 2007 (FR) ..... 07 00032

(51) Int. Cl.
*F04B 35/04* (2006.01)

(52) U.S. Cl. ..... 417/415

(58) Field of Classification Search ..... 417/60, 417/415

See application file for complete search history.

(56) References Cited

U.S. PATENT DOCUMENTS 5,474,744 A * 12/1995 Lerch ..... 422/510
2004/0028565 A1* 2/2004 Abou-Saleh et al. ..... 422/100
2005/0238500 A1 10/2005 Nadel

FOREIGN PATENT DOCUMENTS

DE 198 08 095 A1 10/1998
EP 1 213 479 A1 6/2002
WO 97/31191 A1 8/1997
WO 00/47894 A1 8/2009

* cited by examiner

*Primary Examiner* — Anh Mai
*Assistant Examiner* — Hana Featherly
(74) *Attorney, Agent, or Firm* — Browdy and Neimark, P.L.L.C.

(57) ABSTRACT

The pump unit according to the invention is formed by assembling a pump module (9) comprising a body having a cavity (10) forming a working chamber, a translationally mobile piston (15) engaging leaktightly in the cavity (10) via a seal (14), at least one channel (12, 13) formed in the body to connect the working chamber to a use circuit, a linear actuating module comprising an actuating member (3) that is translationally mobile coaxially with the piston (15), and a connecting and guiding module (18) for establishing a mechanical connection between the pump module (9) and the linear actuating module (2) and for precise guidance of the piston (15) coaxially with the seal.

18 Claims, 3 Drawing Sheets

CROSS-SECTION A-A

CROSS-SECTION A-A

CROSS-SECTION A-A

CROSS-SECTION A-A

LONG-LIFE PUMP UNIT WITH A LINEAR ACTUATING MODULE

BACKGROUND OF THE INVENTION

1. Field of the Invention

The present invention concerns a long-life pump unit, which can be used for a number of types of withdrawals with a view to analyses. It is more particularly, but not exclusively, applicable to pipetting, dilution, rinsing and/or distribution of samples of liquid substances.

In general, one knows that a number of devices have already been proposed making it possible to perform pipetting and rinsing cycles, in particular within an analysis device.

2. Description of the Prior Art

These devices typically involve the use of a pumping module comprising a body provided with a working chamber, for example cylindrical, and a piston which can be in the form of a plunger which engages leaktightly in the working chamber. Actuation the piston is then done by a linear actuator comprising a rotating electric motor, for example of the step-by-step type, and a member converting the rectilinear movement into a rectilinear translational movement.

It has been seen that the pumping devices of this type currently produced have a certain number of drawbacks:

First of all, the conversion system which is used significantly increases the complexity of the device assembly as well as its cost.

Moreover, one encounters alignment problems between the linear movement actuation member and the piston: the alignment defects at this level lead to creating, on the seal which procures the leaktightness between the piston and the body of the pumping module, transverse stresses and, as a result, areas where abnormally high friction is produced which leads to premature wear of the seal. This is a relatively important drawback which increases maintenance costs and which, very often, reduces the life of the pumps.

Moreover, one drawback of the existing pump devices resides in the absence of modular nature and, in particular, of the possibility of quick interchangeability of the pumping module and the actuator.

OBJECT OF THE INVENTION

The invention therefore more particularly aims to eliminate all of these drawbacks.

SUMMARY OF THE INVENTION

To this end, it proposes a pump unit realized in three modules able to be easily assembled or disassembled, namely:

a pump module of the aforementioned type comprising a body provided with a cavity constituting a working chamber, a translationally mobile piston engaging leaktightly in the cavity via a seal arranged between said body and said piston, at least one channel formed in the body to connect the working chamber to a use circuit, said body comprising an assembly surface centered perpendicular to the axis of movement of the piston, a linear actuating module comprising an actuating member that is translationally mobile coaxially with the piston, and a connecting and guiding module for establishing a mechanical connection between the pump module and the linear actuating module and for precise guidance of the piston coaxially with the seal, this guidance being independent of the guide means used by the actuating module.

Advantageously, the coupling between the actuating member and the piston is ensured by the assembly, on one hand, of a cylindrical-spherical seal involving the use of a spherical head centered on the axis of the actuating member and connected thereto by an under-head portion with a section smaller than the diameter of the sphere and, on the other hand, a cylindrical groove formed in the end of the piston opposite the pump member, perpendicular to the axis of said piston, this cylindrical groove opening axially to the outside via a slot having a width smaller than the diameter of the groove and slightly larger than said under-head portion. The spherical head which is integral with the actuating member engages in the spherical groove and is held there axially in both directions. However, it can swivel in the groove while also being able to move in the axis of the groove.

Thus, thanks to these arrangements, an alignment flaw between the actuating member and the piston will not create any stress of a nature to cause premature wear of the dealing device, or even a sealing defect.

Moreover, the aforementioned channel may be formed so as to be able to receive all or part of a single- or multi-path valve or a hollow needle serving for pipetting.

In the latter case, the pump unit may comprise means allowing its fixing on a mobile element of an automatic or semi-automatic pipetting device.

BRIEF DESCRIPTION OF THE DRAWINGS

One embodiment of the invention will be described below, as a non-limiting example, with reference to the appended drawings in which.

DESCRIPTION OF THE PREFERRED EMBODIMENTS

Figure 2:
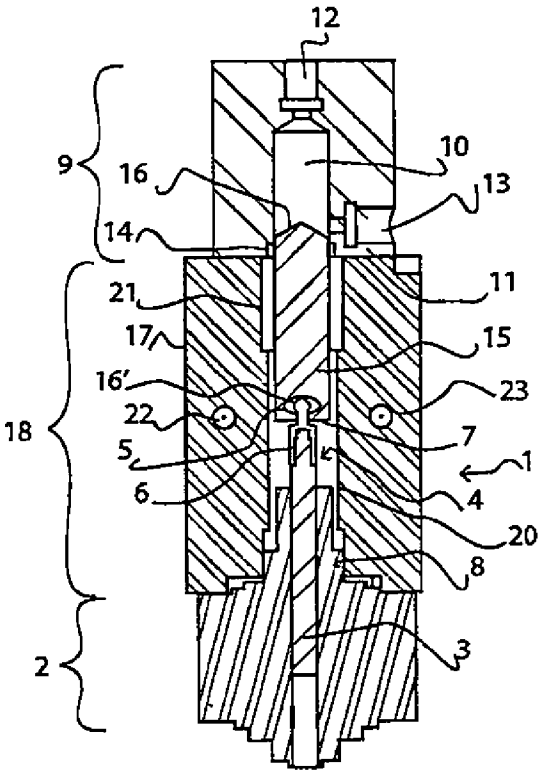
FIG. 2 is an axial cross-section along A/A of FIG. 1.
Figure 1:
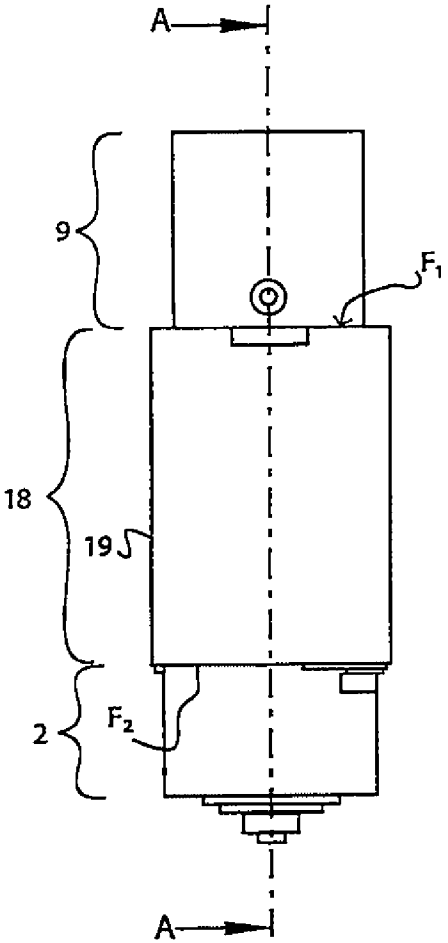
FIG. 1 is a side view of a pump unit according to the invention.

In the example illustrated in FIGS. 1 and 2, the pumping unit 1 involves the use of an actuating module 2 of the jack screw type comprising:

A step-by-step electric motor whereof the rotor comprises a tapped coaxial central bore in which a rod 3 having a threaded portion cooperating with the tapping is engaged. This rod 3, which forms the actuating member, has, moreover, a ribbed portion which engages in a sliding bearing having a complementary smaller section, integral with the stator part of the motor. One of the two ends of the rod is extended by a tip 4 comprising a spherical head 5 connected to a cylindrical socket 6 via an underhead portion 7 having a diameter smaller than that of the head 5 and the cylindrical socket 6. The cylindrical socket 6 is provided with a tapping which screws on a threading provided at the end of the rod 3.

The stator part of the motor comprises a coupling sleeve 8 whereof the outer shape is that of a cylinder, stepped. It has a coaxial central passage in which the rod 3 slides.

The pump unit 1 comprises a pump module 9 including a single-piece body, for example cylindrical or parallelepiped rectangle, precisely formed in a machinable and/or moldable material and having a very low coefficient of expansion.

This body comprises a coaxial cylindrical cavity 10 opening via an orifice located at the center of one of these surfaces 11 which constitute an assembly surface.

This cavity 10, which constitutes the working chamber of the pump, is connected with the outside via two channels 12, 13 enabling a connection to respective use circuits.

One of these channels 12 is arranged coaxially to the cavity 10, opposite the orifice. It opens at the top of a coaxial conical surface constituting the bottom of the cavity.

The other channel 13 extends perpendicular to the axis of the cavity 10, near the surface 11.

The cavity 10 comprises, near its orifice, a bore stepping in which a seal 14 is engaged, through which the piston 15 of the pumping module 9 slides leaktightly.

This piston 15, which consists of a plunger having a cylindrical shape, has on one side, a conical end 16, with a shape substantially complementary to that of the bottom of the cavity 10 and, on the other side, a flat terminal surface in which opens a diametric cylindrical groove 16', centered perpendicular to the axis of the piston 15.

In this example, the connecting and guiding module 18 consists here of a metallic block 17 (for example in aluminum alloy) with a parallelepiped shape whereof two opposite surfaces $F_1$, $F_2$ serve as assembly surface for the pump module 9 and for the actuating module 2, respectively, and a lateral surface 19 which serves as a fixing surface of the pump unit on a support (for example in an analysis machine).

The block 17 comprises a coaxial central bore 20 opening into the surfaces $F_1$, $F_2$.

This bore 20 comprises, on the side of the surface $F_1$, a bore stepping extending over approximately ¼ of its length in which a tubular section 21 in a material with a small friction coefficient (such as, for example, a fluorocarbon, PTFE, FEP) is arranged. This tubular section 21 serves as sliding bearing for the piston 15.

The bore 20 comprises, on the side of the surface $F_2$, steps in which the steps of the coupling sleeve 8 of the actuating module 2 engage tightly.

Thus, in the assembled position of the three modules, with coupling of the rod 3 and the piston 15, all of the elements animated by the translational movements are supposed to be coaxial.

However, if there is an alignment flaw between the rod 3 and the piston 15 (for example due to the dimensional tolerance of the steppings of the actuating module, for example in the case where the actuating module is purchased such as in business), this alignment defect cannot have consequences for the sealing device due to the precision of the guidance of the piston 15 and the type of piston 15/rod 3 coupling which is used.

This structure also has the advantage of being able to be assembled or disassembled very simply (for example by screwing/unscrewing of screws arranged parallel to the axis of the rod 3/piston 15 assembly).

This structure allows interchangeability of the modules, for example to adapt the pump unit 9 to the application of which it is the object.

The fixing of the pump unit 9 on a support can be done using two screws centered parallel to the axis of the piston. Channels 22, 23 realized in the module 18 perpendicular to the assembly surface 19 serve to fix the pump.

Of course, the invention is not limited to the embodiment previously described.

Thus, for example, the pump module 9 could comprise at least one solenoid valve controlling the passage of fluid in one of the channels 12, 13. Advantageously, this solenoid valve could be integrated into the block constituting the pump module 9.

Figure 4:
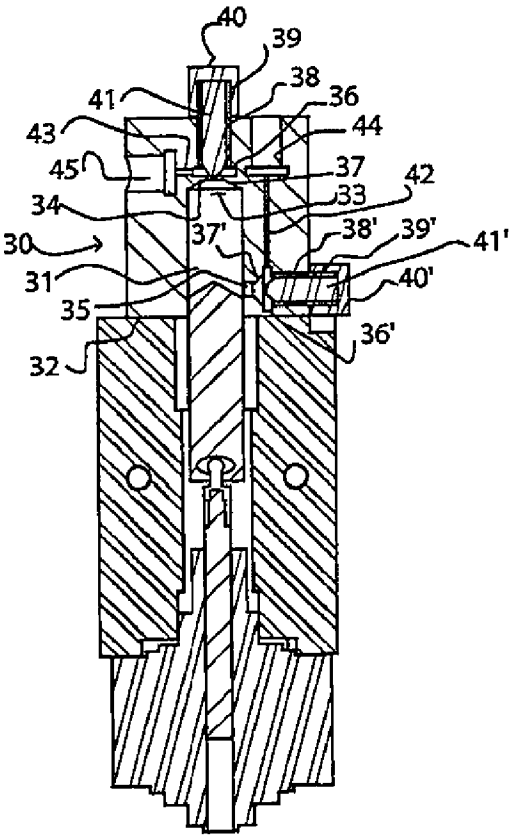
FIG. 4 is an axial cross-section along B/B of FIG. 3.
Figure 3:
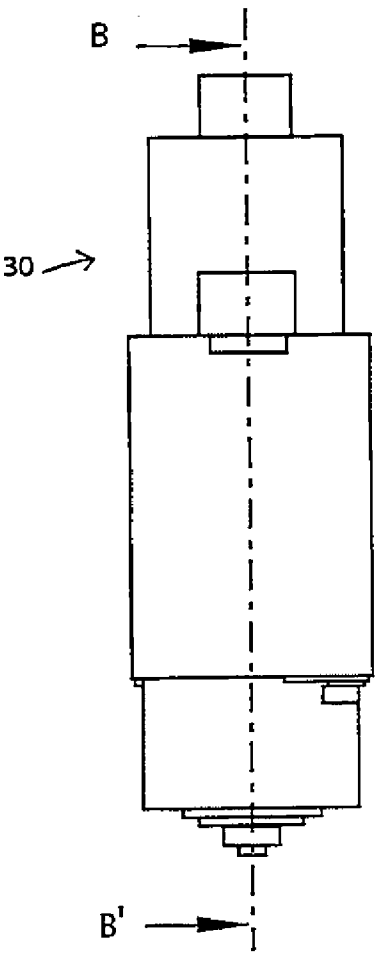
FIG. 3 is a side view of a variation of embodiment of the pump unit.

In the example illustrated in FIGS. 3 and 4, the pump module comprises a single-piece body 30 similar to that described in the preceding example.

Similarly, it comprises a coaxial cylindrical cavity 31 opening at the assembly surface 32. This cavity 31, which constitutes the working chamber of the pump, is connected with the outside via two channels, namely:

a channel 33 arranged coaxially to the cavity 31 and opening at the top of a coaxial conical surface 34 constituting the bottom of the cavity 31, a channel 35 which extends perpendicular to the axis of the cavity 31, near the assembly surface 32.

In this example, each of the channels 33, 35 successively comprises, starting from the cylindrical cavity 31, a cylindrical section of small diameter connected to a cylindrical section 36, 36' with a larger diameter via a conical portion 37, 37' serving as sealing face. The cylindrical section of larger diameter 36, 36' is extended by a tapped portion 38, 38' leading to the outside.

In the tapped portions 38, 38' are leaktightly screwed the bodies 39, 39' of a solenoid valve closing device 40, 40' comprising a closure which is in the form of a needle 41, 41' whereof the conical end has the same conicity as the conical portion 37, 37'.

This needle 41, 41' is actuated by a coil (not illustrated) located inside the solenoid valve 40, 40'.

The cylindrical section 36, 36' defines a closure chamber which is connected to the outside via a channel 42, 43 opening into a cylindrical cavity 44, 45 provided with a tapping serving to connect a flexible tube, preferably in transparent plastic material.

In this example, the channel 43 which opens into the cylindrical section 36 extends perpendicular to the axis of the cylindrical cavity 31 such that the cavity 45 is formed in a lateral surface of the block.

The channel 42 which opens into the cylindrical section 36' extends parallel to the axis of the cylindrical cavity 31 such that the cavity 44 is formed in the (upper) surface of the body 30 located opposite the motorization.

The interest of the solution previously described consists in that insofar as the body 30 is formed in transparent material, the entire journey of the liquid through the pump is visible. Moreover, the connections of the tubes are done in a plane parallel to the front surface of the body (plane of FIG. 4) such that one can also observe the circulation of the liquid inside these tubes.

Moreover, thanks to the integration of solenoid valves 40, 40' in the body 30, one obtains a compact and not very voluminous assembly which can easily be housed in an apparatus, possibly on a mobile part.

Figure 5:
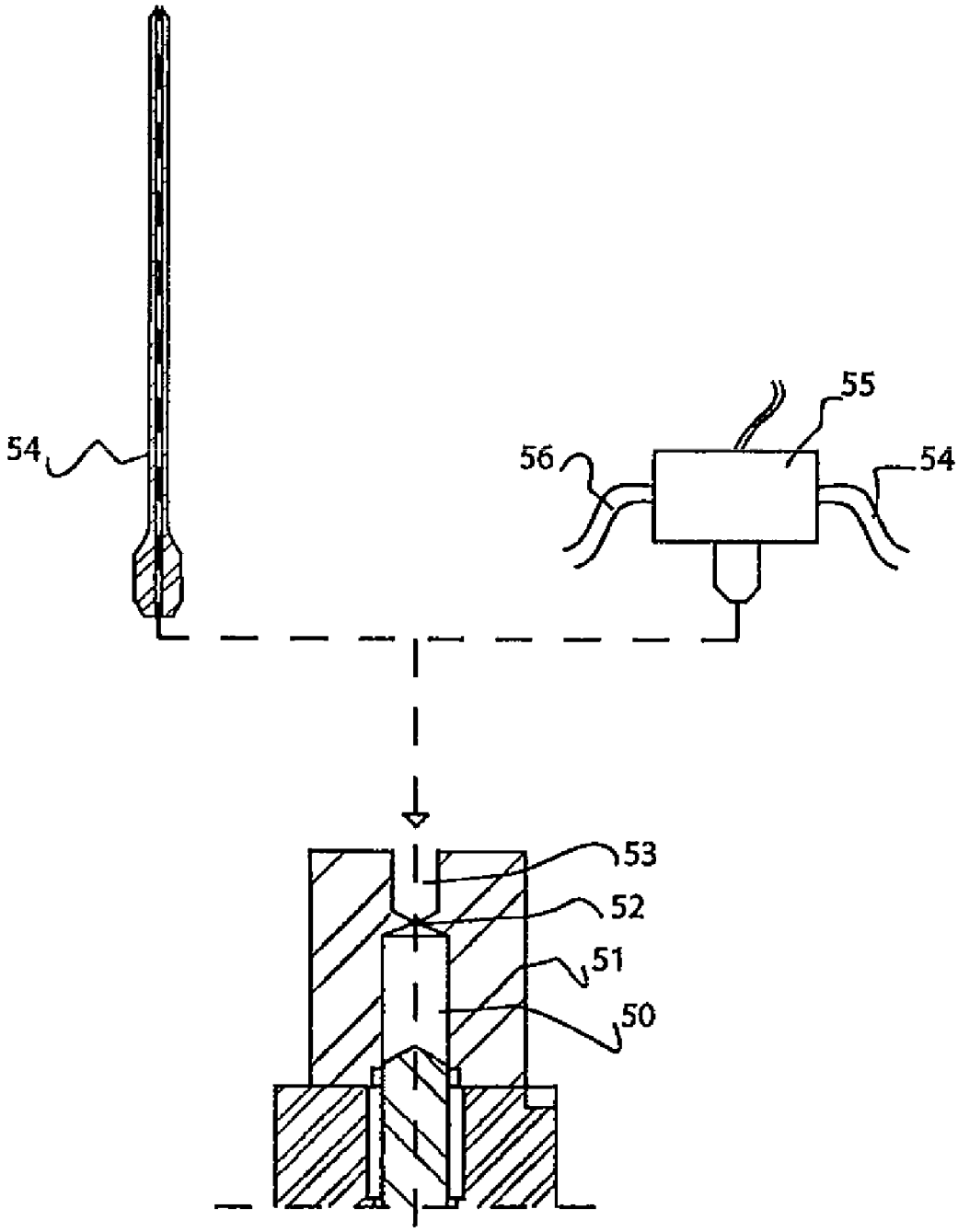
FIG. 5 is a partial diagrammatic cross-section showing a pump module on which a multi-path solenoid valve or a pipetting needle can be connected.

In the example illustrated in FIG. 5, the cylindrical cavity 50 of the body 51 is only connected to the outside via a single channel 52 arranged coaxially to the cavity 50, in a position similar to that of the channel 38.

This channel 52 is extended by a coaxial cylindrical cavity 53 in which can be assembled, leaktightly:

either a pipetting needle 54 provided with a connection tip, for example by screwing, or a multi-path closure, for example a three- or four-path solenoid valve 55 having suction and/or discharge outlets on which flexible conduits 56, 57 can be connected.

Figure 6:
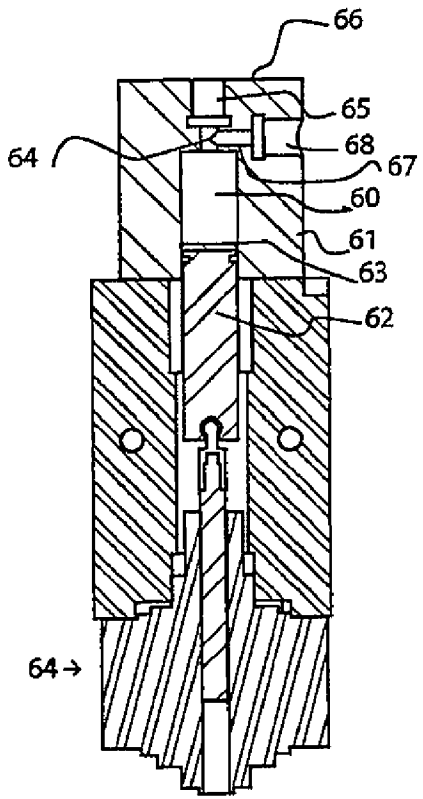
FIG. 6 is an axial cross-section of another variation of embodiment of the pump unit.

In the variation of embodiment illustrated in FIG. 6, inside the cavity 60 of the body 61, a piston 62 provided with a sealing gasket 63 slides leaktightly.

This piston 62 is itself driven by an actuating module 64 of the type described with regard to FIGS. 1 and 2.

Here also, the cylindrical cavity 60 is only connected to the outside via a single channel 64 arranged coaxially to the cavity 60.

This channel 64 is extended by a coaxial cylindrical cavity 65 which opens on the upper surface 66 of the body 61.

It also opens at the outside by a channel/cavity 68 assembly centered perpendicular to the axis of the cylindrical cavity 60. The cavity 68 opens at a lateral surface of the body 61.

The cavities 65 and 68 are designed so as to be able to receive solenoid valves and/or flexible conduits. One of these cavities could possibly be blocked by a closure, the other cavity then being able to receive, for example, a pipetting needle or a stylet.

The invention claimed is:

1. A long-life pump unit, comprising at least one pump module comprising a body provided with a cavity constituting a working chamber, a translationally mobile piston engaging leaktightly in the a cavity via a seal arranged between said body and said piston, at least one channel formed in the body so as to be able to connect the working chamber to a use circuit, said body comprising an assembly surface centered perpendicular to the axis of movement of the piston, and a linear actuating module comprising an actuating member translationally mobile coaxially to the piston, a connecting and guiding module for establishing a mechanical connection between the pump module and the linear actuating module and precise guidance of the piston coaxially to the sealing device, this guidance being independent of the guide means used by the linear actuating module, and wherein the coupling between the actuating member and the piston is ensured via the assembly, on one hand, of a cylindrical-spherical seal having a spherical head centered on the axis of the actuating member and connected thereto by an under-head portion with a section smaller than the diameter of the sphere and, on the other hand, a cylindrical groove realized in the end of the piston opposite the pump member, perpendicular to the axis of said piston, this said cylindrical groove opening axially at the outside by a slot with a width smaller than the diameter of the groove and slightly larger than said under-head portion.

2. The pump unit according to claim 1, wherein the linear actuating module comprises a step-by-step electrical motor whereof the rotor is provided with a tapped coaxial central bore in which a rod constituting the aforementioned said actuating member is housed, said rod comprising a threaded portion which cooperates with the tapping, as well as a ribbed portion which engages in a sliding bearing, with a complementary section, integral with the stator part of the motor, one of the ends of the rod being extended by a tip supporting said spherical head.

3. The pump unit according to claim 2, wherein the spherical head is connected to a cylindrical socket via an under-head portion with a diameter smaller than that of the head of the cylindrical socket, and the cylindrical socket is provided with a tapping which screws on a threading provided at the end of the rod.

4. The pump unit according to claim 2, wherein the stator part of the motor comprises a coupling sleeve whereof the outer shape is stepped, and the connecting and guiding module comprises a bore comprising, on one side, bore steppings in which the steppings of the coupling sleeve of the linear actuating module are tightly engaged.

5. The pump unit according to claim 1, wherein a cavity of the body of the pumping module consists of a bore comprising, at the assembly surface of the body on the connecting and guiding module, a bore stepping in which a sealing device is engaged through which the piston slides leaktightly.

6. The pump unit according to claim 1, wherein the cavity of the pump module is connected to the outside via at least one channel enabling a connection to a use circuit.

7. The pump unit according to claim 6, wherein the pump module comprises at least one single- or multi-path solenoid valve controlling the passage of fluid in the abovementioned channel, said solenoid valve being integrated in part or in whole into said module.

8. The pump unit according to claim 6, wherein said channel is formed so as to be able to receive a hollow needle serving for pipetting.

9. The pump unit according to claim 8, comprising means enabling its fixing on a mobile element of an automatic or semi-automatic pipetting device.

10. The pump unit according to claim 1, wherein a the cavity, which constitutes the working chamber, is connected to the outside via a first channel arranged coaxially to the cavity and a second channel which extends perpendicular to the axis of the cavity, each of said channels successively comprising including, starting from said cavity, a section with a small diameter connected to a section with a larger diameter via a conical portion serving as seating face, the cylindrical section with larger diameter being extended by a tapped portion opening to the outside, and wherein said tapped portion screws onto the body of a closure device in the form of a needle whereof the conical end has the same conicity as the conical portion.

11. The pump unit according to claim 10, wherein the cylindrical section of larger diameter defines a closure chamber which is connected to the outside via a channel opening into a cylindrical cavity provided with a tapping, serving to connect a flexible tube.

12. The pump unit according to claim 11, wherein the channel which opens into the cylindrical section of the first channel extends perpendicular to the axis of the cylindrical cavity, and wherein the channel which opens into the cylindrical section of the second channel, extends parallel to the axis of said cylindrical cavity.

13. The pump unit according to claim 1, wherein a cylindrical cavity of the body which constitutes the working chamber is connected to the outside via a channel arranged coaxially to the cavity, said channel being extended by a coaxial cylindrical cavity in which a pipetting needle or a multi-path closure can be leaktightly assembled.

14. The pump unit according to claim 1, wherein a cylindrical cavity which constitutes the working chamber is connected with the outside via a coaxial channel extended by a coaxial cylindrical cavity which leads to the level of the upper surface of the body, said channel being connected to the outside by a channel or cavity assembly centered perpendicular to the axis of the cylindrical cavity, the cavity opening at a lateral surface of the body.

15. The pump unit according to claim 14, wherein said cavities are designed so as to be able to receive solenoid valves or flexible conduits.

16. The pump unit according to claim 14, wherein one of the cavities is blocked by a closure while the other one receives a pipetting needle or a stylet.

17. The pump unit according to claim 1, wherein the piston has a cylindrical shape, and in that the connecting and guiding module consists of a block whereof two opposite surfaces serve as assembly surfaces for the pump module and the linear actuating module, respectively, and a lateral surface which serves for fixing of the pump unit on a support, said block comprising a coaxial central bore having, from the side of the pump module, a bore stepping in which a tubular section in a material with a low friction coefficient which serves as sliding bearing for the piston is arranged.

18. The pump unit according to claim 1, wherein said actuating member is substantially coaxial to the piston.

* * * * *